US006322038B1

(12) United States Patent
Ghahremani

(10) Patent No.: US 6,322,038 B1
(45) Date of Patent: Nov. 27, 2001

(54) FLUSH-MOUNTED DAVIT APPARATUS

(75) Inventor: Ali Ghahremani, Rowland Heights, CA (US)

(73) Assignee: Skymaster, Inc., City of Industry, CA (US)

( * ) Notice: Subject to any disclaimer, the term of this patent is extended or adjusted under 35 U.S.C. 154(b) by 0 days.

(21) Appl. No.: 09/535,821

(22) Filed: Mar. 28, 2000

(51) Int. Cl.[7] ..... F16M 13/00

(52) U.S. Cl. ..... 248/544; 248/500; 403/322.1; 482/142; 240/544; 52/116

(58) Field of Search ..... 248/544, 673, 248/679, 680, 681, 154, 221.11, 222.12, 500; 403/322.1, 321, 316; 182/142; 240/544; 52/116

(56) References Cited

U.S. PATENT DOCUMENTS 2,622,298 * 12/1952 Macedo ..... 24/211
2,942,903 * 6/1960 Giladett ..... 287/119
4,270,628 * 6/1981 Anderson ..... 187/6
4,424,884 * 1/1984 Smith, Jr. ..... 182/12
4,545,558 10/1985 Crudele .
4,637,492 * 1/1987 Herr ..... 182/93
4,714,226 12/1987 Tracy .
5,332,330 * 7/1994 Kaneko ..... 403/321
5,782,446 6/1998 Ghahremani .

* cited by examiner

*Primary Examiner*—Anita King
*Assistant Examiner*—Kimberly Wood
(74) *Attorney, Agent, or Firm*—Boniard I. Brown

(57) ABSTRACT

A mounting assembly for a davit to support a platform by supporting lines, is secured by a receptacle flush mounted on an elevated floor of a building. The mounting assembly is secured and moved into engagement with the mounting assembly by a socket of a mounting assembly receiving the davit engaging the assembly with the mounting assembly by engagement blocks which engage a locking member in the receptacle upon tilting of the davit mounting assembly toward a vertical position.

18 Claims, 2 Drawing Sheets

FLUSH-MOUNTED DAVIT APPARATUS

BACKGROUND AND SUMMARY OF THE INVENTION

The present invention relates generally to davit mounting assemblies for supporting platforms suspended from building structures, as for workmen and service personnel; more particularly, the invention relates to an improved davit mounting assembly mounted on a flush-mounted receptacle adapted to receive the davit-mounting assembly and to be flush with a supporting surface in a high-rise building, such as a balcony surface.

Elevated platform suspension systems, apparatus and assemblies have long been utilized to provide access by service personnel and workmen to the sides of buildings and structures. Bent arm davits has long been utilized, and davits have long been mounted in sockets in davit-mounting assemblies. A davit is typically mounted on a roof or elevated surface, with suspension lines extending from the davit to support a platform, with two davits typically being utilized.

Prior art davit-mounting arrangements are shown and described in Pat. Nos. 4,714,226 to Tracy, 4,545,558 to Crudele, and 5,782,446 to Ghahremani.

In some applications, it is desirable that the location for mounting and supporting a davit present a pleasing, aesthetic appearance. For example, it is desirable that such floor surfaces as floors of balconies extending from offices in high-rise office buildings, present a pleasing appearance without mechanical equipment being obvious or seen.

The present invention provides a davit mounting assembly for mounting in a flush-mounted receptacle assembly on a horizontal surface of an elevated building structure. The davit mounting assembly is movable, as between a storage facility and the flush-mounted receptacle assembly. The assembly comprises a mechanism for locking engagement with the flush-mounted receptacle assembly upon pivotal movement of the socket of the assembly to engage the receptacle assembly.

DESCRIPTION OF PREFERRED EMBODIMENT

Figure 3A:
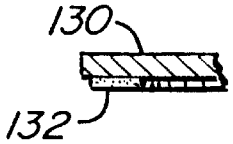
FIG. 3A is a sectional view taken at line 3A–3A in FIG. 3.

Referring to the drawings, a preferred embodiment of the present invention comprises a davit mount assembly 10, a mounting mechanism 20, and a flush mount receptacle 100 mounted in a concrete floor of a building structure, typically a balcony floor of a high-rise building structure. The flush mount receptacle assembly 100 of FIG. 3 is mounted flush with the floor of a balcony, etc., and is secured closed when not mounting a davit mount assembly 10.

Figure 3:
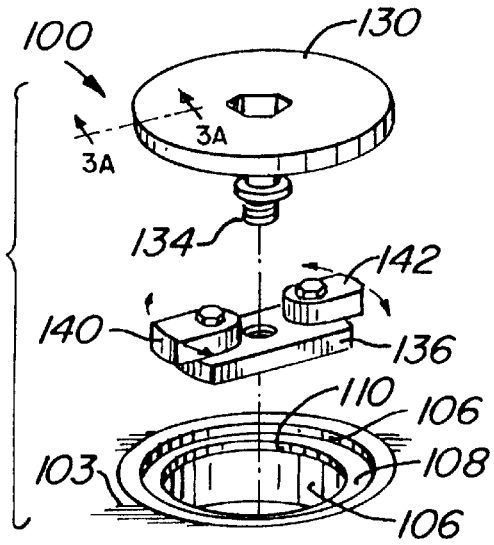
FIG. 3 is an exploded perspective view of a flush-mounted receptacle assembly according to the invention.
Figure 4:
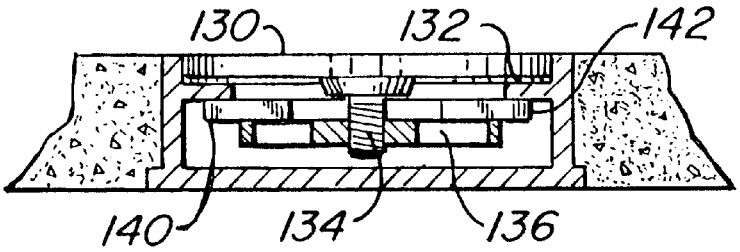
FIG. 4 is a sectional view of the flush-mounted receptacle assembly of FIG. 3 with the components in assembled relation.

Referring to FIGS. 3 and 4, receptacle 100 has a lower flange portion 104 (FIG. 2) for securement in the concrete floor 103, and an annular wall 106 which extends to the finished surface of the roof. A locking flange 108 extends radially inwardly from the wall 106, and defines a circular opening 110. Wings 140, 142 are engageable under the locking flange 108 to secure cover 130 in a locked configuration, with cover 130 thereof flush with the floor surface.

The davit assembly includes a cover 130, which covers a floor opening and is mounted flush with the concrete floor surface. A water-tight seal or gasket 132 is secured to the cover 130, and a threaded axial bolt shaft 134 extends from the cover. A cover adapter block 136 has a central threaded opening to receive threaded shaft 134. Pivotally mounted on adapter block 136, as shown, are wings 140, 142 which are engageable under the locking flange 108.

Figure 1:
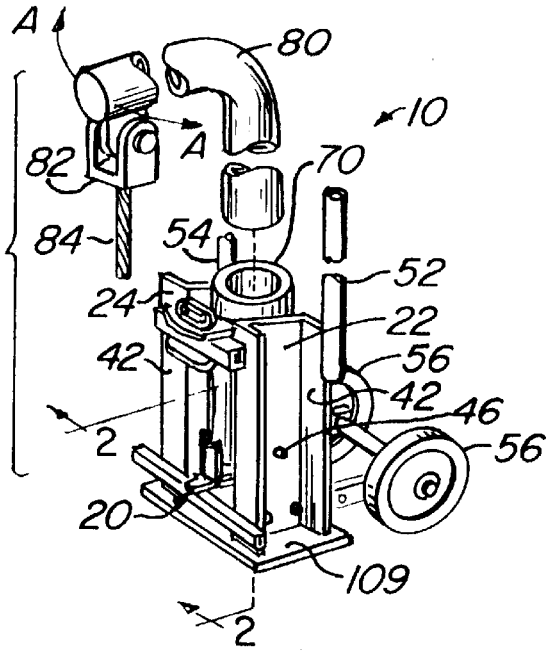
FIG. 1 is a perspective view of a davit mounting assembly according to the present invention.

Referring to FIG. 1, davit assembly 10 has frame members 22, 24 disposed at opposite sides and secured to a bottom plate 109, as by welding. The frame members are disposed opposite each other, and each has outwardly extending flanges 42, 46. Extending upwardly from upper portions of the frame members 22 and 24 are handles 52, 54 (partially shown) for manual grasping for handling and manipulation of the davit mount assembly, utilizing ground wheels 56 of the assembly.

A tubular socket member or pipe 70 is secured, as by welding, between the frame members 22 and 24. A conventional davit 80 is receivable in the socket pipe 70 and is rotatable therein, as indicated by arrows A (FIG. 1). The davit has an upper portion bent 90° to extend outwardly and has at its end portion a linkage 82 to support a woven-wire cable 84. In utilizing the apparatus, two such cables are typically suspended from spaced-apart davits (not shown) to support a platform for persons performing services on a structure or building.

A pair of engagement blocks 114, 116 are pivotally mounted relative to socket pipe 70. Pivotally mounted at 120 on a wheel strut 122 is a locking member arm 124. Mounted thereon, as by welding, is a tab 126 whereon is pivotally mounted a separator 128.

In the installation or removal of the davit 80 (FIG. 1) relative to socket 70, a securement pin (not shown) between the davit and the socket 70 is removed, whereupon socket 70 is rotatable about its pivotal mounting into a tilted position (FIG. 5) to install or remove the davit. It will be understood that it is generally impracticable or unfeasible to insert or remove a davit relative to the socket while the socket is vertical. In conventional manner, with the socket tilted, the davit is slidable thereinto or is removable. The socket is then tilted to its vertical position, and the securing pin is replaced to secure the socket in vertical position.

In order to install the davit mounting assembly 10 at the flush mount receptacle 100, the davit mounting assembly is first grasped, by means of the vertical pipe handle 52, 54 welded to the back of the frame, then is tilted so that the weight of the assembly is borne by the wheels 56. It is then rolled, typically from a storage area, to the flush mount receptacle 100 whereupon it is pivoted to an upright position adjacent to the flush mounted receptacle. A lock pin (not shown) is removed, bolt 134 is removed from cover 130 of the receptacle, and the cover is removed. The socket 70 is rotated about its pivotal mount 111 relative to frame members 22, 24. The separator 128, pivotally mounted on a tab 126 extending from a locking lever arm 124 (FIG. 5), is thereby urged between pivotally mounted engagement blocks 114, 116 to force them apart after they are extended through opening 110 of annular locking member flange or ring 108 of mounting assembly 100 into their positions of FIG. 2 wherein engagement lugs 101, 102 thereof are engaged under the annular ring 108, and the socket tube 70 and davit 80 are secured in their vertical orientation of FIGS. 1 and 2.

Figure 2:
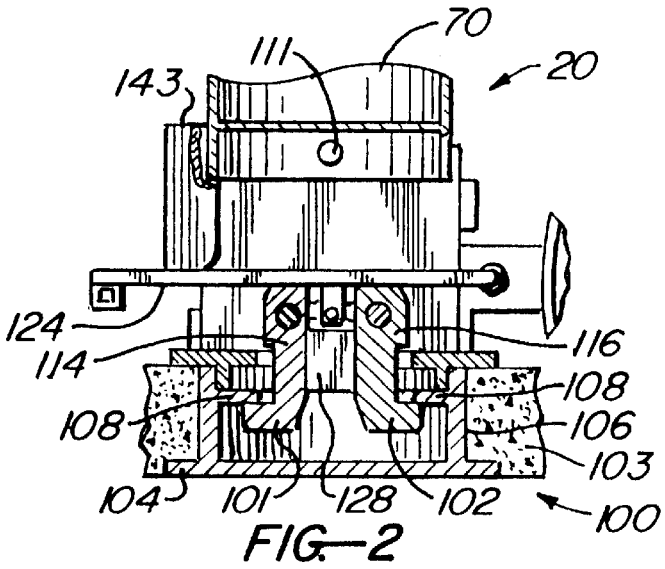
FIG. 2 is a sectional view taken at line 2 in FIG. 1.
Figure 5:
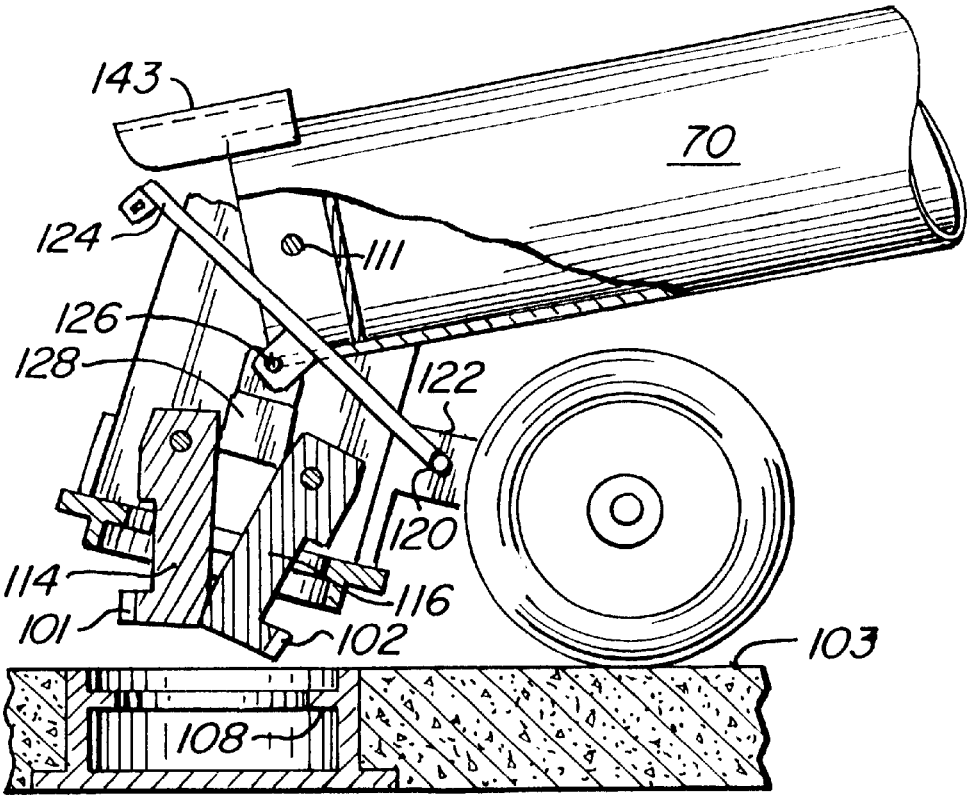
FIG. 5 is a large elevational view of major components of the assembly of FIG. 1 in relation to a portion of the flush-mounted receptacle assembly of FIG. 4 disposed in concrete floor.
Figure 6:
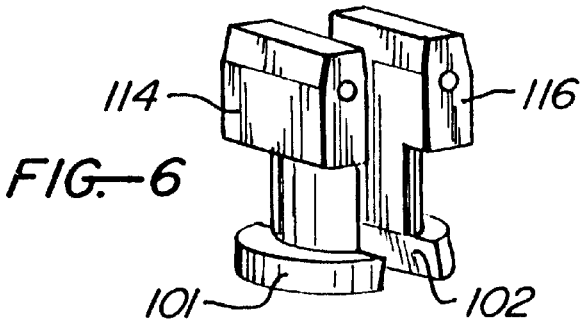
FIG. 6 is a perspective view of engagement block components of the apparatus of FIG. 5.

Concurrently, the locking lever arm 124 is urged pivotally about its pivot connection on strut 120 of the wheel assembly (FIG. 5), from its position of FIG. 5 into its position of FIG. 2, wherein it is secured in position by a safety lock 143 fixedly mounted on the lower portion of socket 70. The assembly is thus secured in the configuration of FIG. 2.

In the removal of the davit assembly from the receptacle assembly 100, the locking arm 124 is rotated to its position of FIG. 2 and socket 70 is tilted to an inclined position, such as that of FIG. 5. The davit 80 is disengaged from the socket tube 70 by removal of a pin therebetween (not shown). The mounting assembly 10 is then removed from the flush mount receptacle 100.

It will be understood that various changes and modifications may be made from the preferred embodiments discussed above without departing from the scope of the present invention, which is established by the following claims and equivalents thereof.

The inventor claims:

1. Apparatus for supporting a davit at a generally horizontal surface of an existing elevated building structure to support a platform therebelow, said apparatus comprising:

a receptacle assembly disposed at the generally horizontal surface, said receptacle assembly comprising a locking member, a davit mounting assembly for receiving and supporting a davit and comprising a pivotally mounted socket to position the davit in selected orientation to engage the davit mounting assembly with the receptacle assembly, said davit mounting assembly comprising two pivotally mounted engagement blocks adapted to engage said locking member of the receptacle assembly, and a separator to move between said engagement blocks to retain the blocks in engagement with said locking member of the receptacle assembly.

2. Apparatus according to claim 1, wherein said receptacle assembly locking member is an inwardly extending flange.

3. Apparatus according to claim 2, wherein:

the davit mounting assembly is secured on the receptacle assembly by engagement of portions of said blocks under said locking member flange upon pivotal movement of said socket.

4. Apparatus according to claim 1, wherein said receptacle assembly has a component adapted to be embedded in a concrete floor of a balcony of said elevated building structure.

5. Apparatus according to claim 1, and further including:

wheels supporting the davit mounting assembly for movement about said surface of an elevated building structure.

6. Apparatus according to claim 1, wherein the assembly has a cover adapted to be flush with said horizontal surface of the elevated building structure when the davit mounting assembly is engaged therewith.

7. Apparatus for supporting a davit to suspend a platform therebelow, said apparatus comprising:

a flush-mounted receptacle assembly adapted to be disposed on a generally horizontal surface of an elevated building structure, said receptacle flush-mounted assembly having a circular flange locking member, a davit mounting assembly having a pivotally mounted socket to receive a davit therein and position the davit in selected orientation, said davit mounting assembly comprising engagement blocks pivotally movable to engage under said flange locking member of the flush-mounted receptacle assembly upon pivotal movement of the davit mounting assembly, said engagement blocks each being pivotal relative to said socket and having respective lug portions extending oppositely for positioning relative to said circular flange locking member upon said pivotal movement of the davit mounting assembly to engage the receptacle assembly, and a separator in the davit mounting assembly and positionable to retain the engagement blocks in engagement with said flange locking member.

8. Apparatus according to claim 7, wherein:

the flush mounting receptacle is embedded adapted to be in material defining said horizontal surface, and said locking flange member extending inwardly therefrom.

9. Apparatus according to claim 7, and further including:

an elongate lock member pivotally mounted to move into generally horizontal orientation to retain said blocks upon pivotal movement of the socket to a generally vertical position.

10. Apparatus according to claim 7, wherein the flush-mounted receptacle assembly is adapted to be disposed on an elevated floor of a high-rise building structure.

11. Apparatus according to claim 7, wherein said flush-mounted receptacle assembly is adapted to be embedded in a concrete floor of a balcony of a high-rise building structure.

12. Apparatus according to claim 7, wherein said davit mounting assembly is wheel-mounted for movement about the surface of an elevated building structure.

13. Apparatus according to claim 9, and further including:

a separator on said elongated lock member pivotal and disposed to move between said engagement blocks upon movement of said socket toward a vertical position to maintain said engagement blocks apart when engaged under said locking member of the flush-mounted receptacle assembly, whereby upon tilting of the socket toward a vertical orientation thereof, the separator is urged between the engagement blocks to maintain them in engagement under said locking member.

14. Apparatus according to claim 1, wherein said receptacle assembly is adapted to be flush-mounted relative to said surface of the existing building structure.

15. Apparatus according to claim 7, wherein said receptacle assembly is adapted to be flush-mounted relative to said surface of the existing building structure.

16. Apparatus according to claim 1, wherein the davit mounting assembly is rotatable 360° relative to the receptacle assembly to any selected orientation.

17. Apparatus according to claim 7, wherein the davit mounting assembly is rotatable to 360° relative to the flush-mounted receptacle assembly to any selected orientation.

18. Apparatus according to claim 1, wherein:

said locking member is generally circular, and said engagement blocks have lug portions adapted to engage under the locking member, whereby the davit mounting assembly is rotatable 360° on the receptacle assembly.

* * * * *